6/19/84 XR 4,455,346

United States Patent [19]

Igarashi et al.

[11] 4,455,346

[45] Jun. 19, 1984

[54] HEAT-SENSITIVE RECORDING PAPER

[75] Inventors: Akira Igarashi; Sukenori Nakamura, both of Shizuoka, Japan

[73] Assignee: Fuji Photo Film Co., Ltd., Kanagawa, Japan

[21] Appl. No.: 390,736

[22] Filed: Jun. 21, 1982

[30] Foreign Application Priority Data

Jun. 19, 1981 [JP] Japan ..... 56-94851

[51] Int. Cl.[3] ..... B41M 5/18

[52] U.S. Cl. ..... 346/200; 427/150; 427/361; 427/363; 427/365; 428/408; 428/336; 428/913

[58] Field of Search ..... 282/27.5; 427/150–153, 427/359, 361, 363, 365; 428/211, 320.4–320.8, 336, 342, 408, 411, 537, 913, 914, 488

[56] References Cited

FOREIGN PATENT DOCUMENTS 54-115255 9/1979 Japan ..... 282/27.5

2028526A 3/1980 United Kingdom ..... 282/27.5

*Primary Examiner*—Bruce H. Hess

*Attorney, Agent, or Firm*—Sughrue, Mion, Zinn, Macpeak and Seas

[57] ABSTRACT

A heat-sensitive recording paper comprising a paper support having coated thereon a heat-sensitive recording layer, which is surface-treated by passing said recording paper, after drying said heat-sensitive recording layer, through a pressure-applying member comprising a combination of a metal roll and an elastic roll of from 70 to 90 in Shore hardness wherein said heat-sensitive layer surface is contacted with said metal roll.

5 Claims, No Drawings

HEAT-SENSITIVE RECORDING PAPER

FIELD OF THE INVENTION

This invention relates to a heat-sensitive recording paper. Heat-sensitive recording papers are designed to provide images by utilizing physical or chemical change of a substance caused by heat energy. Many processes using various heat-sensitive recording papers have been investigated.

BACKGROUND OF THE INVENTION

Recently, heat-sensitive recording papers have come into use as recording papers for recording facsimile output data or computer output data, utilizing the advantages of heat-sensitive recording papers, such as that they form color based on primary coloration, and that they require no developing step. Such heat-sensitive recording papers are usually referred to as "dye type", and are disclosed in Japanese Patent Publication Nos. 4160/68 and 14039/70. Japanese Patent Application (OPI) No. 27253/80 (The term "OPI" as used herein refers to a published unexamined Japanese patent application), etc.

In general, the use of a heat-sensitive recording paper as the recording paper enables to use a light and small-sized recording apparatus. Thus, heat-sensitive recording papers have recently come into increased use. On the other hand, heat-sensitive recording papers typically have the defect that the recording speed cannot be increased as high as desired due to a limited response speed of the recording element, since heat is used as the recording energy. In order to overcome this defect, various efforts have been made with respect to recording devices and recording papers. One of them is to increase smoothness of the surface of heat-sensitive recording paper, specifically to conduct calender treatment.

However, such surface treatment for imparting smoothness is accompanied by various defects.

One defect is fogging. That is, the coloration reaction takes place during the surface-treating step to cause coloration of recording paper. As an approach to overcome this problem, addition of granular wax has been proposed (Japanese Patent Publication No. 14531/75). However, waxes generally have a large heat capacity and a large heat of fusion, thus deteriorating the heat response of heat-sensitive recording paper.

Another defect of such treatment is a deterioration of writing properties with respect to pencils, ball-point pens, etc.

A third defect is a bonding phenomenon between the recording element and the recording paper in colored portions due to seriously increased adhesion between the recording element and the heat-sensitive recording paper which deteriorates running properties.

In spite of these various defects, the surface treatment at present must unavoidably be conducted for imparting smoothness due to comparatively large contribution of the improvement of smoothness to the improvement of the recording speed.

SUMMARY OF THE INVENTION

It is, therefore, an object of the present invention to obtain a heat-sensitive recording paper which overcomes the above-described defects and which has a high heat transmission efficiency between the recording element and the heat-sensitive recording paper.

The above-described object of the present invention can be attained by a heat-sensitive recording paper comprising a paper support having coated thereon a heat-sensitive recording layer, and which is surface-treated by passing said recording paper, after drying said heat-sensitive recording layer, through a pressure-applying member comprising a combination of a metal roll and an elastic roll of from 70 to 90 in Shore hardness (Hs) wherein said heat-sensitive recording layer surface is contacted with said metal roll.

DETAILED DESCRIPTION OF THE INVENTION

The Shore hardness (Hs) of the elastic roll to be used in the present invention is from 70 to 90 degrees, with from 75 to 85 degrees being particularly preferable.

The method for measuring Shore hardness (Hs) is described in *Kagaku Dai-Jiten* (Encyclopaedia Chimica), published by Kyoritsu Shuppan K.K., Vol. 4, p. 748 (1962).

The heat-sensitive recording paper of the present invention provides sufficient image density in actual recording using a facsimile or the like in spite of its low apparent smoothness, i.e., Bekk smoothness as specified by JIS (Japanese Industrial Standard)—P-8119. The Bekk smoothness is represented by the time (sec.) required to pass 10 cc of air between the paper and the smooth glass surface through a circular opening at the center of the glass surface under a pressure of 1 kg/cm$^2$. In addition, it has good antifogging and writing properties. The use of hard rubber as a material for the elastic roll particularly increases this tendency.

In contrast, if the pressure-applying member to be used uses a hard metal roll instead of the elastic roll, the fogging of heat-sensitive recording layer appears directly upon formation of the base paper, thus being unfavorable.

In addition, even when the pressure-applying member comprises a combination of a metal roll and an elastic roll, an elastic roll with an excessively high Shore hardness causes fogging as in the case of using a metal roll in place of the elastic roll. On the other hand, when the hardness of the elastic roll is too small, enormous pressure is required to impart surface smoothness, again resulting in fogging due to the pressure.

A general process for producing heat-sensitive recording paper of the present invention is to coat a heat-sensitive coating solution on a base paper and then dry the coated recording layer to reach a level of 10 wt% or less water content. As one example, a heat-sensitive coating solution can be prepared by dispersing an electron donating colorless dye such as crystal violet lactone and an electron accepting compound such as 2,2-bis(4-hydroxyphenyl)-propane in an aqueous polyvinyl alcohol solution as fine particles of several microns or less in size. As to these processes detailed descriptions are given in Japanese Patent Publication Nos. 4160/68 and 14039/70 and Japanese Patent Application (OPI) Nos. 27253/80, 93492/80, 14281/80, etc.

Particles to be dispersed in the heat-sensitive coating solution are not more than 8 μm, and preferably not more than 4 μm, in volume mean diameter represented by $$\left(\sqrt[3]{\int_0^\infty fD_p^3 dD_p}\right)$$

wherein f is a frequency distribution of particle diameters and $D_p$ is a particle diameter. The reason for this is that the heat-sensitive color-forming layer is generally coated in a thickness of from 5 to 10 μm, and hence presence of coarse particles failes to provide sufficient effects even when the surface treatment of the present invention is conducted.

The present invention will now be described in more detail by the following example of a preferred embodiment of the invention, which, however, is not intended to limit the invention in any way.

EXAMPLE 1

20 kg of crystal violet lactone was dispersed in a 300-liter ball mill for about 24 hours together with an aqueous 10 wt% polyvinyl alcohol (saponification degree: 98%; polymerization degree: 500) solution. Similarly, 20 kg of 2,2-bis(4-hydroxyphenyl)propane was dispersed in a 300-liter ball mill for about 24 hours together with an aqueous 10 wt% polyvinyl alcohol solution. The two dispersions were mixed in such proportions that the ratio of crystal violet lactone to 2,2-bis(4-hydroxyphenyl)propane was 1:5 by weight. Then, 5 kg of light-fine calcium carbonate was added to 20 kg of the mixture, and was well dispersed to obtain a coating solution.

This coating solution was air knife-coated on a base paper having a basis weight of 50 g/m$^2$ and a Bekk smoothness of 25 seconds in a coating amount of 6 g/m$^2$ (as solids), and, after drying to reach a level of 6 wt% water content, the coated paper was passed between a pressure-applying member comprising a combination of a hard chromium-plated roll and a hard rubber roll (Shore hardness: 80) to conduct surface treatment. The thus obtained heat-sensitive recording paper was subjected to a recording procedure conducted by applying a voltage of 20 V to an exothermic element (347Ω) having exothermic areas of 0.2 mm×0.2 mm for periods of 2 msec. such that an energy of 2 ms/dot and 50 mJ/mm 2 was given to a recording element with a recording density of 5 dots/mm in main scanning (a perpendicular direction to a scanning direction of papers) and 6 dots/mm in sub-scanning (a scanning direction of papers), and reflection density at 610 nm (maximum absorption wavelength of crystal violet lactone colored product) thereof was measured.

Further, Bekk smoothness and writing properties of the above-described heat-sensitive recording paper were evaluated.

The results thus obtained are shown in Table 1. The evaluations of the writing properties in Table 1 were measured with the eye whether the letters are clearly written without thin letters, letters of a low color density or letters made fine when the letters are written on the above-described heat-sensitive recording paper using a ball-point pen and a pencil.

EXAMPLE 2

The heat-sensitive recording paper was prepared by coating and drying in the same manner as in Example 1 except that the surface-treatment was conducted using a pressure-applying member comprising a combination of a hard rubber roll (Shore hardness: 70) with the chromium-plated roll. The properties of the resulting heat-sensitive recording paper were evaluated in the same manner as in Example 1.

EXAMPLE 3

The heat-sensitive recording paper was prepared by coating and drying in the same manner as in Example 1 except that the surface-treatment was conducted using a pressure-applying member comprising a combination of a hard rubber roll (Shore hardness: 90) with the chromium-plated roll. The properties of the resulting heat-sensitive recording paper were evaluated in the same manner as in Example 1.

COMPARATIVE EXAMPLES 1 TO 3

Separately, for comparison, comparative sample 1 was obtained by surface-treating a heat-sensitive recording paper which had been prepared by coating and drying in the same manner as in Example 1 using a pressure-applying member comprising a combination of a cast iron-made metal roll (Shore hardness: 100) with the chromium-plated roll.

Further, a heat-sensitive recording paper prepared by coating and drying in the same manner as in Example 1 and not surface-treated was used as comparative sample 2.

Furthermore, a heat-sensitive recording paper prepared by coating and drying in the same manner as in Example 1 and surface-treated using a pressure-applying member comprising a combination of a hard rubber roll (Shore hardness: 55) with the chromium-plated roll was used as comparative sample 3.

The above-described comparative samples 1 to 3 were subjected to the same recording procedure as in Example 1 to evaluate properties. Results thus obtained are shown in Table 1.

Table 1 clearly shows the superiority of the heat-sensitive recording paper according to the present invention.

TABLE 1

| Example No. | Sample No. | Pressure-applying Roll | Bekk Smoothness (sec.) | Recorded Density | Fogging | Writing Properties |
|---|---|---|---|---|---|---|
| Example 1 | Sample 1 | Combination of a hard chromium-plated roll and a hard rubber roll (Shore hardness: 80) | 180 | 1.31 | 0.08 | good |
| Example 2 | Sample 2 | (Shore hardness: 70) | 160 | 1.28 | 0.08 | good |
| Example 3 | Sample 3 | (Shore hardness: 90) | 210 | 1.32 | 0.08 | good |
| Comparative Example 1 | Comparative Sample 1 | Combination of the chromium-plated roll and a cast iron-made | 210 | 1.22 | 0.11 | thin letters and hardly read |

TABLE 1-continued

| Example No. | Sample No. | Pressure-applying Roll | Bekk Smoothness (sec.) | Recorded Density | Fogging | Writing Properties |
|---|---|---|---|---|---|---|
| | | metal roll (Shore hardness: 100) | | | | |
| Comparative Example 2 | Comparative Sample 2 | not used | 95 | 0.88 | 0.08 | good |
| Comparative Example 3 | Comparative Sample 3 | Combination of the chromium-plated roll and a hard rubber roll (Shore hardness: 55) | 120 | 1.05 | 0.08 | good |

Note:
Good means no thin letters.

While the invention has been described in detail and with reference to specific embodiments thereof, it will be apparent to one skilled in the art that various changes and modifications can be made therein without departing from the spirit and scope thereof.

What is claimed is:

1. A heat-sensitive recording paper comprising a paper support having coated thereon a heat-sensitive recording layer, which is surface-treated by passing said recording paper, after drying said heat-sensitive recording layer, through a pressure-applying member comprising a combination of a metal roll and an elastic roll of from 70 to 90 in Shore hardness wherein said heat-sensitive layer surface is contacted with said metal roll.

2. A heat-sensitive recording paper as in claim 1, wherein the Shore hardness of the elastic roll is from 75 to 85.

3. A heat-sensitive recording layer as in claim 1 or 2, wherein the elastic roll consists of hard rubber.

4. A heat-sensitive recording paper as in claim 1 or 2, wherein the thickness of the heat-sensitive recording layer is from 5 to 10 $\mu$m.

5. A heat-sensitive recording paper as in claim 1 or 2, wherein the coated recording layer is dried to reach a level of 10 wt% or less water content.

* * * * *